US009211977B2

(12) United States Patent
Elder

(10) Patent No.: US 9,211,977 B2
(45) Date of Patent: Dec. 15, 2015

(54) BOTTLE CLOSURE HAVING A WOOD TOP

(71) Applicant: Jack E. Elder, Oakland Township, MI (US)

(72) Inventor: Jack E. Elder, Oakland Township, MI (US)

( * ) Notice: Subject to any disclaimer, the term of this patent is extended or adjusted under 35 U.S.C. 154(b) by 54 days.

(21) Appl. No.: 14/015,827

(22) Filed: Aug. 30, 2013

(65) Prior Publication Data

US 2015/0060390 A1 Mar. 5, 2015

(51) Int. Cl.
*B65D 39/16* (2006.01)
*B65D 39/00* (2006.01)

(52) U.S. Cl.
CPC ..... *B65D 39/16* (2013.01); *B65D 39/0052* (2013.01)

(58) Field of Classification Search
CPC ..... B65D 2543/00287; B65D 39/0011; B65D 39/0005; B65D 39/0058; B65D 41/58; B65D 41/28; B65D 36/16; B65D 39/0052; B65D 39/00
USPC ..... 215/364, 355; 220/789, 787, 800, 801; 428/35.6, 35.7; 217/79, 78, 76
See application file for complete search history.

(56) References Cited

U.S. PATENT DOCUMENTS

| | | | | | |
|---|---|---|---|---|---|
| 1,721,210 | A * | 7/1929 | Dalley | 215/291 |
| 2,091,350 | A * | 8/1937 | Bomeisler et al. | 215/364 |
| 2,192,511 | A * | 3/1940 | Thomas | 215/364 |
| 2,419,743 | A * | 4/1947 | Taylor | 215/364 |
| 3,146,806 | A * | 9/1964 | Ginsburg | 141/110 |
| 4,182,458 | A * | 1/1980 | Meckler | 215/307 |
| 5,710,184 | A * | 1/1998 | Burns | 521/50 |
| 2008/0078737 | A1* | 4/2008 | Brennan et al. | 215/364 |
| 2008/0116165 | A1* | 5/2008 | Lin | 215/294 |

FOREIGN PATENT DOCUMENTS

| | | | | |
|---|---|---|---|---|
| EP | 667298 | A1 * | 8/1995 | B65D 39/16 |
| GB | 190014711 | A * | 0/1901 | B65D 39/0011 |
| GB | 190626392 | A * | 0/1907 | B65D 39/0011 |
| GB | 777991 | A * | 7/1957 | B65D 39/16 |

* cited by examiner

*Primary Examiner* — Robert J Hicks
(74) *Attorney, Agent, or Firm* — Maginot, Moore & Beck LLP

(57) ABSTRACT

A closure for a bottle includes a stopper portion and a head portion. The stopper portion has an axial length and a first width. The stopper portion is configured to be received at least in part within a bottle. The stopper portion has a wooden inner part and a polymer outer part. The head portion has a second width that exceeds the first width. Continuities in the wooden inner part strengthen the mechanical connection between the polymer outer part and the wooden inner part.

15 Claims, 3 Drawing Sheets

BOTTLE CLOSURE HAVING A WOOD TOP

FIELD OF THE INVENTION

The present invention relates generally to bottle closures.

BACKGROUND OF THE INVENTION

Bottle closures for consumable liquids, for example, olive oil, syrup, spirits and wine, have historically been metal and/or cork material. Cork is made from bark of certain trees, for example, the Cork Oak. Cork has qualities particularly suited to storing liquids in bottles because it features impermeability and a certain level of compressibility that allows for both a tight closure and removability. In contrast to bark, wood fibers do not have sufficient compressibility.

Due to extensive use, however, cork supplies are limited, thereby driving up price. Moreover, cork closures carry with them the risk of a taint that can be passed into the liquid. For example, it has been estimated that as many as seven percent of wine bottles have some level of "corking", or taint imparted by the cork.

By far, the most popular closure for mass-produced bottled liquids is the metal "screw top cap". Metal screw tops are formed of a metal skirt and plastic sealing layer. Screw tops extend over the outside of the bottle, as opposed to corks that are inserted into the bottle neck. While screw top caps are not susceptible to taint, screw top caps lack aesthetic appeal, which is particularly disadvantageous for higher-valued products such as fine spirits, fine wine, and higher end olive oil and maple syrup.

In other cases, it has been found that certain polymers can be used for bottle closures that behave in a manner more similar to cork. Polymer closures can have similar compressibility. However, polymer closures similarly suffer from a lack of aesthetics associated with fine spirits, wine and other products. Furthermore, polymer closures are given to "creep", which deforms the closure over time and can lead to failure.

Some attempts have been made to combine certain materials with the polymer closure to take advantage of the mechanical properties of the polymer while improving the aesthetics. In one example, a closure includes a wooden head or cork head portion glued to a thermoplastic polymer portion. The thermoplastic polymer portion inserts into the bottle, while the wooden head remains outside the bottle and provides a gripping portion for extraction. The drawback of this design is that the glue joints often fail, causing separation of the polymer sealing material from the wood.

What is needed is a bottle closure that has sealing qualities comparable to cork, while having a suitable aesthetic human interface.

SUMMARY OF THE INVENTION

The present invention addresses the above state need, as well as others, by providing a bottle closure having a wooden core (and head), with a polymer molded onto the wooden core. The wooden core provides structural integrity and the wooden head provides convenient and aesthetic removal interface.

In a first embodiment, a closure for a bottle includes a stopper portion and a head portion. The stopper portion has an axial length and a first width. The stopper portion is configured to be received at least in part within a bottle. The stopper portion has a wooden inner part and a polymer outer part. The head portion has a second width that exceeds the first width.

Structures of the wooden inner part are used to strengthen the coupling between the wooden inner part and the polymer outer part.

In another embodiment, a closure for a bottle includes a wooden part and polymer. The wooden element has a shaft portion and a head portion, the head portion having a width greater than the shaft portion. The shaft portion extends in an axial direction. At least one polymer is molded onto the shaft portion to form a substantially cylindrical outer portion configured to be received by a bottle in the axial direction.

The above-described features and advantages, as well as others, will become more readily apparent to those of ordinary skill in the art by reference to the following detailed description and accompanying drawings.

DETAILED DESCRIPTION

Figure 1:
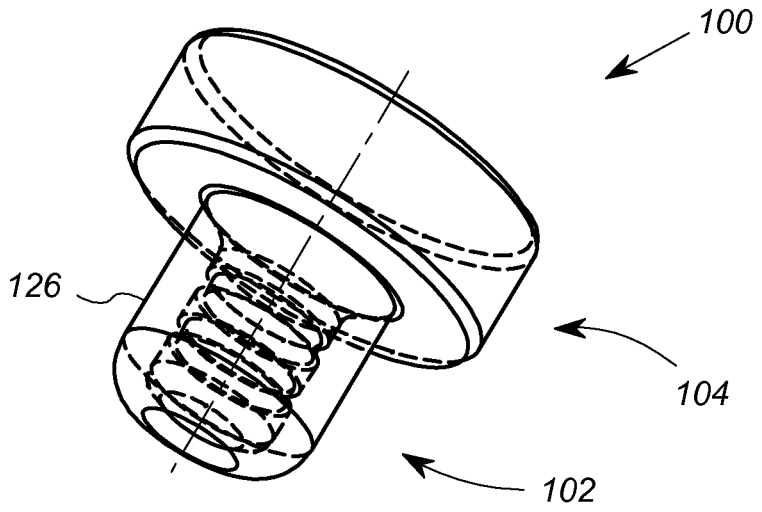
FIG. 1 shows perspective view of a bottle closure according to at least one embodiment of the invention.
Figure 2:
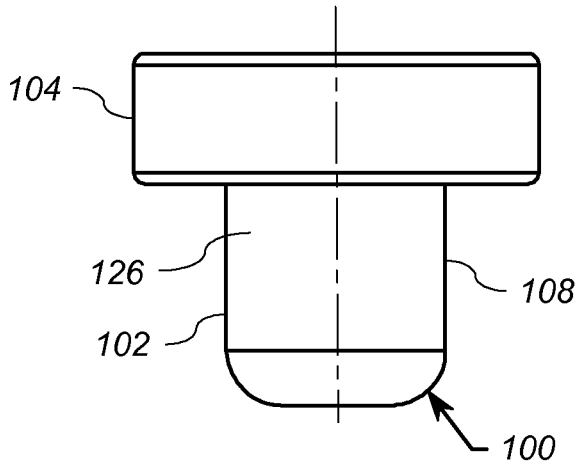
FIG. 2 shows a side plan view of the bottle closure of FIG. 1.
Figure 3:
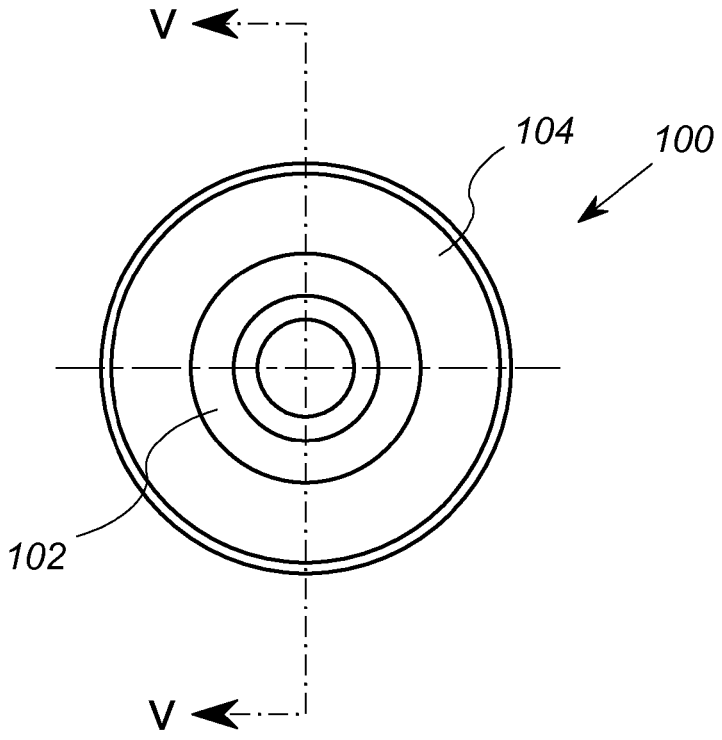
FIG. 3 shows a bottom plan view of the bottle closure of FIG. 1.

FIG. 1 shows perspective view of a bottle closure 100 according to at least one embodiment of the invention. FIGS. 2 and 3 show, respectively, side and bottom plan views of the bottle closure. Reference is made to FIGS. 1, 2, and 3 simultaneously. The bottle closure 100 includes a stopper portion 102 and a head portion 104, and includes a substantially cylindrical outer wall 126. The stopper portion 102 has an axial length and a width in the radial direction. The width of the stopper portion 102 is sized such that the stopper portion 102 can be tightly received at least in part within the neck of a bottle containing spirits, wine, olive oil, maple syrup, mineral water, and other liquids, not shown. The stopper portion 102, when received with the bottle, is slightly compressed to form a liquid tight fit within the bottle. The head portion 104 has a width that exceeds the width of the stopper portion 102, and is not received with the neck of a standard bottle, but is rather configured to abut a top axial-facing edge of the bottle, as is conventional.

Figure 4:
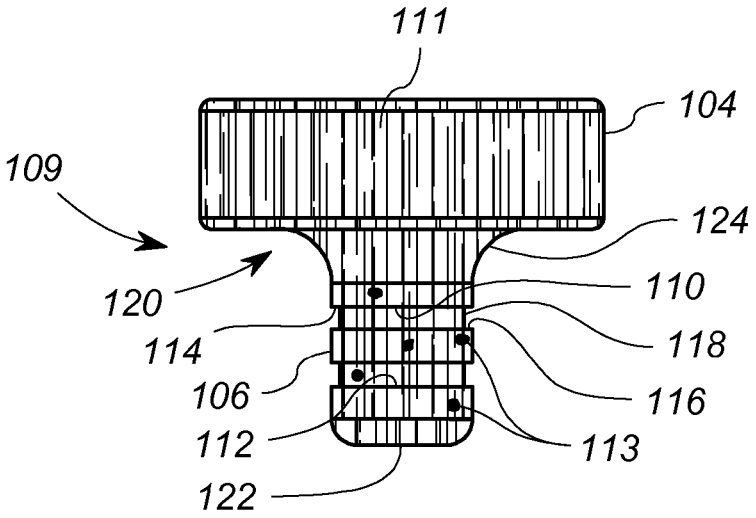
FIG. 4 shows a side plan view of a wood portion of the bottle closure of FIG. 1.
Figure 5:
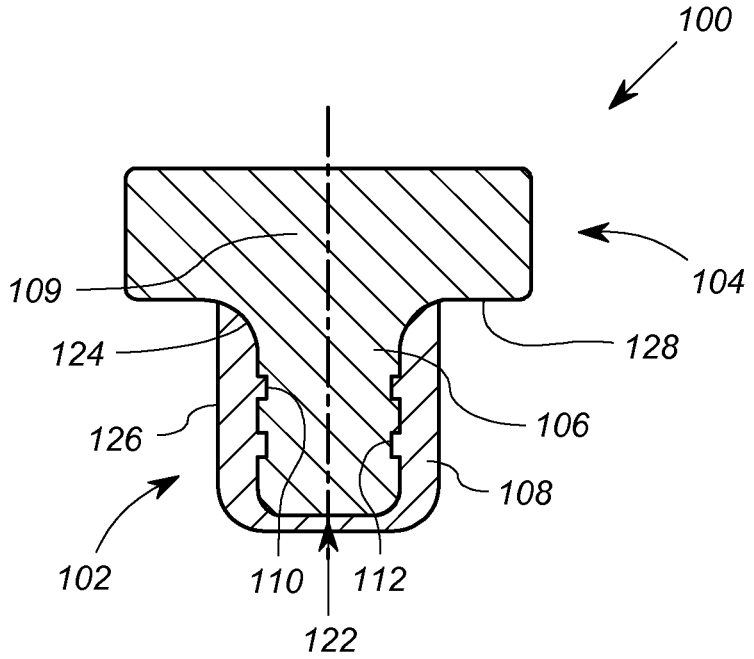
FIG. 5 shows a side cutaway view of a first embodiment of the bottle closure of FIG. 1.
Figure 6:
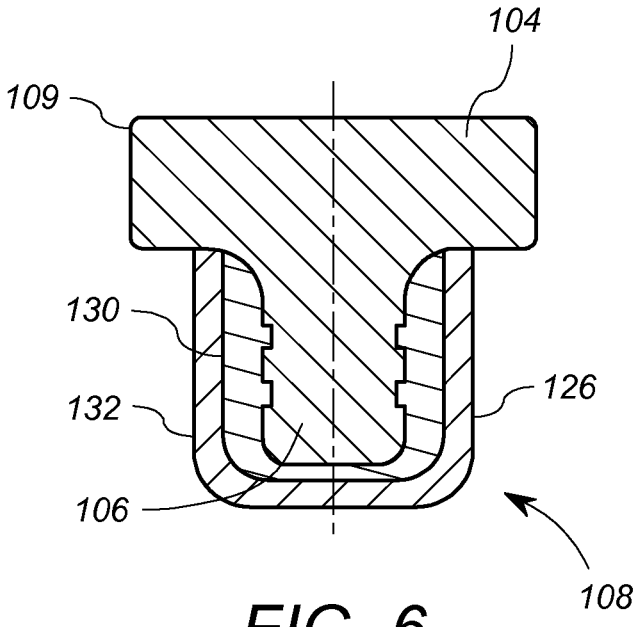
FIG. 6 shows a side cutaway view of a second embodiment of the bottle closure of FIG. 1.

With reference to FIG. 4, in addition to FIGS. 1-3, the stopper portion 102 includes a wooden inner part 106 and a polymer outer part 108. FIG. 4 shows a side plan view of the wooden inner part 106 and the head portion 104. The wooden inner part 106 and the head portion 104 are integrally formed of a single, turned piece of wood, referred to hear as the wood part 109. FIGS. 5 and 6, discussed further below, show different embodiments of the polymer outer part 108. In general, however, the polymer outer part 108 defines a substantially cylindrical outer surface 126 that is configured to engage the inner surface of the neck of a bottle.

As discussed above, the head portion 104 and the wooden inner part 106 are integrally formed from a single piece of wood, as opposed to bark material used for corks. Suitable wood materials include, but are not limited to beech, birch, maple, oak, bamboo. The wooden inner part 106 is in the form of a shaft having a first end 120 at the intersection of the head portion 104, and a distal or second end 122.

The wooden inner part or shaft 106 defines a generally cylindrical structure having at least one discontinuity. The discontinuity provides an area where the polymer outer part 108 can contract onto and "grip" the wooden inner part 106 during the molding process. In this embodiment, the discontinuities include two annular grooves 110, 112. The annular groove 110 includes a radially extending upper surface 114, a radially extending lower surface 116 and an axial inner surface 118. The annular groove 112 may suitably have the same structure. The annular grooves 110, 112 are spaced apart on the wooden inner part 106 by an axial distance that is roughly equivalent to the axial width of the axial inner surface 118. Similarly, the annular grooves 110, 112 are spaced apart from the two axial ends 120, 122 of the wooden inner part/shaft 106.

One feature of the annular grooves 110, 112 is the provision of an undercut, preferably in a radial plane. For example, in the annular groove 110, the upper surface 114 and the lower surface 116 form undercuts. As will be discussed below in further detail, when the polymer outer part 108 is molded onto the wooden inner part 106, the polymer engages the undercuts and contracts, thereby strengthening the retention force of the polymer outer part 108 on the wooden shaft 106. Accordingly, it will be appreciated that suitable undercuts may take other forms, such as detents, bores, and the like. One advantage of a continuous annular groove such as the grooves 110, 112 is that it allows the undercuts to be formed in a rotating wood working fixture, such as a lathe.

It is also preferably that the grain 111 of the wood part 109 be oriented in the axial direction, or in other words, substantially parallel to the angle of insertion into the bottle. Such orientation advantageously provides maximum bending strength on the core, and optimum fiber orientation for product insertion and extraction forces.

Accordingly, to construct the wood part 109, a blank wood piece is loaded onto a lathe or other rotating machine such that the grain of the wood blank is parallel to the axis of rotation. Suitable machining methods are used on the rotating wood blank to form the wood part 109 as shown in FIG. 4. It will also be appreciated that the machining methods typically causes random chipping-out, or random hollow spots 113, which create their own discontinuities that aid in the bonding of the polymer material to the wood shaft 106.

In this embodiment, the wooden shaft 106 also includes an annular mold mating structure 124 at the first end 120, adjacent to an engaging the underside of the head portion 104. The annular mold mating structure 124 in this embodiment defines an inclined annular surface similar to a fillet structure. The annular mold mating structure 124 is configured to provide an interface for the molding fixture, not shown. The molding fixture can clamp down and slightly deform the mating structure 124 to form a tight contact ring between the mold and the shaft, thereby inhibiting or preventing undesirable leaks or flashing of the polymer material beyond its intended position.

As discussed above, the polymer outer part 108 defines a substantially cylindrical outer wall 126 that engages the inner wall of a bottle. In a first embodiment discussed below in connection with FIG. 5, the polymer outer part 108 consists of a single, molded polymer that is molded over the wooden shaft 106. In a second embodiment discussed below in connection with FIG. 6, the polymer outer part 108 consists of at least two molded polymers having different physical characteristics.

Referring to FIG. 5, shown is a side cutaway view of the first embodiment of the bottle closure 100 of FIG. 1 having a single, molded polymer structure. Like reference numbers will be used to illustrate like features from FIGS. 1 to 4. The polymer outer layer 108 is a single material molded onto the shaft portion to form a substantially cylindrical outer surface 126 configured to be received by a bottle in the axial direction. To this end, the mold, not shown, comprises a negative of the outer cylindrical surface 126 of the polymer outer layer 108. The mold is clamped against the annular mold mating structure 124 to prevent polymer material from flashing out to the underside 128 of the head portion 104.

It can be seen that the polymer outer layer 108 fills the annular grooves 110, 112, and forms a layer over the second end 122 of the wooden shaft 106. In the cross-section shown in FIG. 5, the polymer outer layer 108 makes up between 25% and 75% of the width of the stopper portion 102. The resulting thickness of the wood shaft 106 provides strengthening characteristics not present in the polymer material.

When the polymer cures, it contracts (shrinks), forming axial clamping forces on the undercuts (e.g. radially extending surfaces 114, 116) and on the second end 122 of the wooden shaft 106. The polymer preferably shrinks at least one or two percent. Such clamping forces help secure the structure and prevent failure or separation. In addition, the random "pitting" or hollow spots 113 on the shaft 106 formed during the manufacturing process provides places for the polymer to lock during post-molding shrinkage to enhance the mechanical bond. This method of mechanical shrinkage bonding provides superior torque resistance between the wood shaft 106 and the polymer shaft 108. Such torque resistance is particularly advantageous because this type of closure is often rotated, relative to the bottle, upon insertion and extraction. Also, the porosity and pits in the wood (imperfections) provide excellent asymmetric, random grip points for the shrink bond of the molded polymer.

Accordingly, the material of the polymer outer portion 108 should be chosen such that it is soft or elastic enough to allow for bottle insertion and extraction, while providing a tight liquid seal, and have sufficient hardness to secure itself about the wooden shaft 106. To this end, the polymer may suitably be one or more of propylene, thermoplastic elastomer, a blowing agent (endothermic), or SEBS. One suitable blend is the TPE and blowing agent described in U.S. Pat. No. 5,710,184.

FIG. 6 shows a second embodiment of the bottle closure wherein the polymer outer layer 108 includes a first polymer layer 130 and a second polymer layer 132. The first polymer layer 130 preferably includes a hard polymer layer 130 molded onto the wooden shaft 106 similar to method described above in connection with FIG. 5. A second polymer layer 132 is molded onto the first polymer layer 130, and forms the outer cylindrical wall 126 of the polymer outer layer 108. The molding process creates a cohesive bond between the second polymer layer 132 and the first polymer layer 130.

The first polymer layer 130 has a greater hardness, and may have greater shrinkage, than the second polymer layer 132, thereby allowing for strong coupling to the wood shaft 106. The second polymer layer 132 may be softer, and even softer than the polymer material of the embodiment of FIG. 1, because the second polymer layer 132 has a cohesive bond to the first polymer layer 130. The combination of the layers 130 and 132 make for a strong closure device, with enhanced flexibility for insertion into and retraction out of the bottle. The wooden shaft 106, as with the embodiment of FIG. 5, provides strength and prevents degradation of the structural soundness of the polymer over time, which can be an issue with all polymer closures.

In one preferred embodiment the first polymer layer 130 may include polypropylene and the second polymer layer 132 may include thermoplastic elastomer (TPE). However, either or both of these materials may be altered.

It will be appreciated that the above-described embodiments are merely illustrative, and that those of ordinary skill in the art may readily devise their own implementations and modifications that incorporate the principles of the present invention and fall within the spirit and scope thereof. By way of example, it will be appreciated that the dimensions of the closure 100 may be altered to suit the bottle neck design. In addition, the length of the stopper portion 102 and width of the head portion 104 may be altered without departing from the principles of the embodiments described herein.

In addition, it will be appreciated that the discontinuities used to strengthen the bond between the wood shaft 106 and the polymer out layer(s) may take different forms. While the embodiment described herein relies on annular grooves 110, 112 and hollow spots 113 chipped out during machining, at least some embodiments may rely solely on discontinuities formed by chipped-out hollow spots 113 formed during the machining of the shaft. In addition, other forms of chipping or forming of overhangs the shaft 106 may be employed. Nevertheless, the use of annular grooves advantageously provides substantial gripping overhangs that require relatively simple manufacturing processes.

What is claimed is:

1. A closure for a bottle, comprising a stopper portion having an axial length and a first width, the stopper portion configured to be received at least in part within a bottle, the stopper portion comprising a wooden inner part and a polymer outer part; and a head portion having a second width that exceeds the first width, wherein:

the wooden inner part comprises a shaft, said shaft comprising a cylindrical structure including at least one annular groove defining at least one discontinuity, and the polymer outer part defines a substantially cylindrical outer surface.

2. The closure of claim 1, wherein the head portion is constructed of wood, wherein said wood head portion and said wooden inner part are integrally formed from a single piece of wood.

3. The closure of claim 2, wherein the single piece of wood has a grain direction, and wherein the grain direction is substantially aligned in the axial direction.

4. The closure of claim 1, wherein the polymer outer part further comprises a first polymer layer and a second polymer layer, the first polymer layer disposed between the second polymer layer and the wood inner part.

5. The closure of claim 4, wherein the first polymer layer part has a different hardness than the second polymer layer.

6. The closure of claim 1, wherein the shaft includes an annular tapered portion tapering radially outward to an underside of the head portion.

7. A closure for a bottle, comprising a wooden element having a shaft portion and a head portion, the head portion having a width greater than the shaft portion, the shaft portion extending in an axial direction;

at least one polymer molded onto the shaft portion to form a substantially cylindrical outer portion configured to be received by a bottle in the axial direction.

8. The closure of claim 7, wherein the head has a width that exceeds a width of an opening in the bottle.

9. The closure of claim 8, wherein the shaft portion comprises a cylindrical structure having at least one discontinuity.

10. The closure of claim 9, wherein said shaft includes at least one annular groove defining the at least one discontinuity.

11. The closure of claim 10, wherein the annular groove defines at least one undercut, the undercut having a surface extending substantially in a radial direction normal to the axial direction.

12. The closure of claim 7, wherein the single piece of wood has a grain direction, and wherein the grain direction is substantially aligned in the axial direction.

13. A closure for a bottle, comprising a wooden element having a shaft portion and a head portion, the head portion having a width greater than the shaft portion, the shaft portion extending in an axial direction;

a first polymer layer molded onto the shaft portion; and a second polymer layer molded onto the first polymer layer to form a substantially cylindrical outer portion configured to be received by a bottle in the axial direction.

14. The closure of claim 13, wherein the first polymer layer has a different hardness than the second polymer layer.

15. The closure of claim 14, wherein the shaft portion comprises a cylindrical structure having at least one discontinuity.

* * * * *